US005235993A

United States Patent [19]

Obara et al.

[11] Patent Number: 5,235,993

[45] Date of Patent: Aug. 17, 1993

[54] VARIABLE SPEED TRANSFERRING DEVICE FO A CIGARETTE WRAPPING APPARATUS

[75] Inventors: Koichiro Obara; Tadao Etani, both of Tokyo, Japan

[73] Assignee: Japan Tobacco Inc., Tokyo, Japan

[21] Appl. No.: 878,999

[22] Filed: May 6, 1992

[30] Foreign Application Priority Data

May 8, 1991 [JP] Japan ..... 3-102850

[51] Int. Cl.[5] ..... A24C 5/33

[52] U.S. Cl. ..... 131/282; 131/283; 198/450

[58] Field of Search ..... 131/280, 282, 283, 94, 131/904-905, 907, 908; 198/418.5, 418.6, 478.1, 471.1, 450; 53/148-151

[56] References Cited

U.S. PATENT DOCUMENTS 4,592,374 6/1986 Focke et al. .
4,614,263 9/1986 Nagata et al. .
4,693,359 9/1987 Mattei et al. ..... 131/282 X
4,711,339 12/1987 Nagata et al. .

FOREIGN PATENT DOCUMENTS 0134590 9/1984 European Pat. Off. .
2098971 5/1982 United Kingdom .
2196928 5/1988 United Kingdom ..... 131/282

*Primary Examiner*—V. Millin
*Assistant Examiner*—J. Doyle
*Attorney, Agent, or Firm*—Birch, Stewart, Kolasch & Birch

[57] ABSTRACT

A variable speed transferring device for a cigarette parallel-arranging device used in a cigarette wrapping apparatus comprises variable speed transferring drums disposed between a plurality of cigarette parallel-arranging drums for holding groups of parallel-arranged cigarettes and a cigarette piling drum. Each variable speed transferring drum is provided on its peripheral surface with holding grooves for holding at least one group of parallel-arranged cigarettes and is rotated by a variable speed driving mechanism at a lower speed when the holding grooves face the variable speed transferring drums and at a higher speed when the holding grooves face the piling drum. Since the peripheral speed of the receiving drums disposed upstream of the variable speed transferring drums is lowered, the shock applied to cigarettes when they are received by the receiving drums from cigarette supplying passageways is reduced and the speed-up of the operation of the variable speed transferring device is achieved.

3 Claims, 8 Drawing Sheets

VARIABLE SPEED TRANSFERRING DEVICE FO A CIGARETTE WRAPPING APPARATUS

BACKGROUND OF THE INVENTION

1. Field of the Invention

This invention relates to a variable speed transferring device for a cigarette wrapping apparatus, and more particularly to a variable speed transferring device for a cigarette wrapping apparatus, in which device a speed variable transferring drum, which changes the rotational speed of the variable speed transferring device during one revolution, is disposed between cigarette parallel-arranging drums and a cigarette piling drum such that the peripheral speed of the cigarette parallel-arranging drums is reduced and the peripheral speed of the piling drum is increased.

2. Description of the Related Art

In general, a cigarette wrapping apparatus is provided with a cigarette parallel-arranging device which takes out cigarettes from a hopper or the like containing cigarettes randomly arranges the cigarettes in parallel and piles them in three steps in a staggered manner such that, of twenty cigarettes to be packed in a box, seven, six and seven cigarettes constitute the lower step, the intermediate step and the upper step, respectively. The cigarette wrapping apparatus is further provided with a packing device for wrapping piled cigarettes with aluminum foil or wrapping sheets. The cigarette wrapping apparatus is still further provided with a sealing device for attaching seals (sealing pieces, for example) to cigarette packages. The cigarette parallel-arranging device, the packing device and the sealing device are integrally connected to each other to form a cigarette wrapping apparatus. Cigarettes put in the hopper or the like are sent out from the cigarette wrapping apparatus as packed final products.

The cigarette parallel-arranging device is formed with cigarette supplying passageways whose number corresponds to the number of cigarettes in a box (twenty, for example). Many cigarettes put in the hopper are sent, one by one, into each of the cigarette supplying passageways in a state arranged in parallel. Each cigarette receiving drum receives cigarettes one by one from the respective cigarette supplying passageway. The cigarettes held by the cigarette receiving drums are transferred onto three cigarette parallel-arranging drums such that the cigarette parallel-arranging drums receive seven, six and seven cigarettes, respectively, for example, which form three parallel-arranged cigarette groups. These three groups of cigarettes are transferred onto a cigarette piling drum to form a block of twenty cigarettes filed in a staggered manner. The piled cigarettes are sent to the packing device and packed.

Recently, the speed of wrapping has been becoming higher and higher. Since the cigarette parallel-arranging drums make mere rotational movement, they can be operated at a higher speed. However, the cigarettes taken out of the cigarette supplying passageways are accelerated very quickly from the stationary state to the peripheral speed of the drums. Thus the cigarettes receive a large shock at a high speed at which the drums are driven, resulting in cigarette damage. Further, because the peripheral speeds of the cigarette receiving drums and the other drums must be equal in order to carry out the transfer of cigarettes therebetween, only the peripheral speed of the cigarette receiving drums can not be lowered. In this regard, the speed of the cigarette parallel arranging device is limited.

SUMMARY OF THE INVENTION

It is accordingly an object of this invention to speed up the operation of the cigarette parallel-arranging device which is used in a cigarette wrapping apparatus, arranges cigarettes in parallel and piles them in a staggered manner so as to be wrapped as cigarette boxes.

In order to attain this object, a variable speed transferring device according to this invention comprises a plurality of cigarette parallel-arranging drums for forming corresponding parallel-arranged groups of cigarettes, a cigarette piling drum for receiving the groups of cigarettes from the cigarette parallel-arranging drums and piling the groups of the parallel-arranged cigarettes in a staggered manner, and a variable speed transferring drum disposed between the cigarette parallel-arranging drums and the cigarette piling drum. Cigarettes are taken out, one by one, from the respective cigarette supplying passageways. The cigarettes held by the cigarette receiving drums are transferred to three cigarette parallel-arranging drums thereby forming three parallel-arranged cigarette groups consisting of seven, six and seven cigarettes, respectively. These groups of cigarettes are temporarily received by the speed variable transferring drums and then transferred to the cigarette piling drum. The variable speed transferring drums are driven by a speed variator. The rotational speed of the transferring drums is varied during one revolution thereof such that the peripheral speed of the transferring drums changes periodically. The speed change occurs in such a way that the peripheral speed is lowered when the cigarette holding grooves approach the cigarette parallel-arranging drums and is increased when the cigarette holding grooves pass by the cigarette piling drum.

Since the peripheral speed of the cigarette piling drum for piling the groups of parallel-arranged cigarettes in a staggered manner becomes higher and the peripheral speed of the cigarette receiving drums disposed upstream of the cigarette parallel-arranging drums becomes lower, the shock which cigarettes receives when they are transferred from the supplying passageways to the cigarette receiving drums is reduced and thus the cigarettes are prevented from being damaged. Therefore, the operational speed of the cigarette parallel-arranging device can be enhanced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

An embodiment of a cigarette supplying and stopping device will be described with reference to the drawings.

Figure 1:
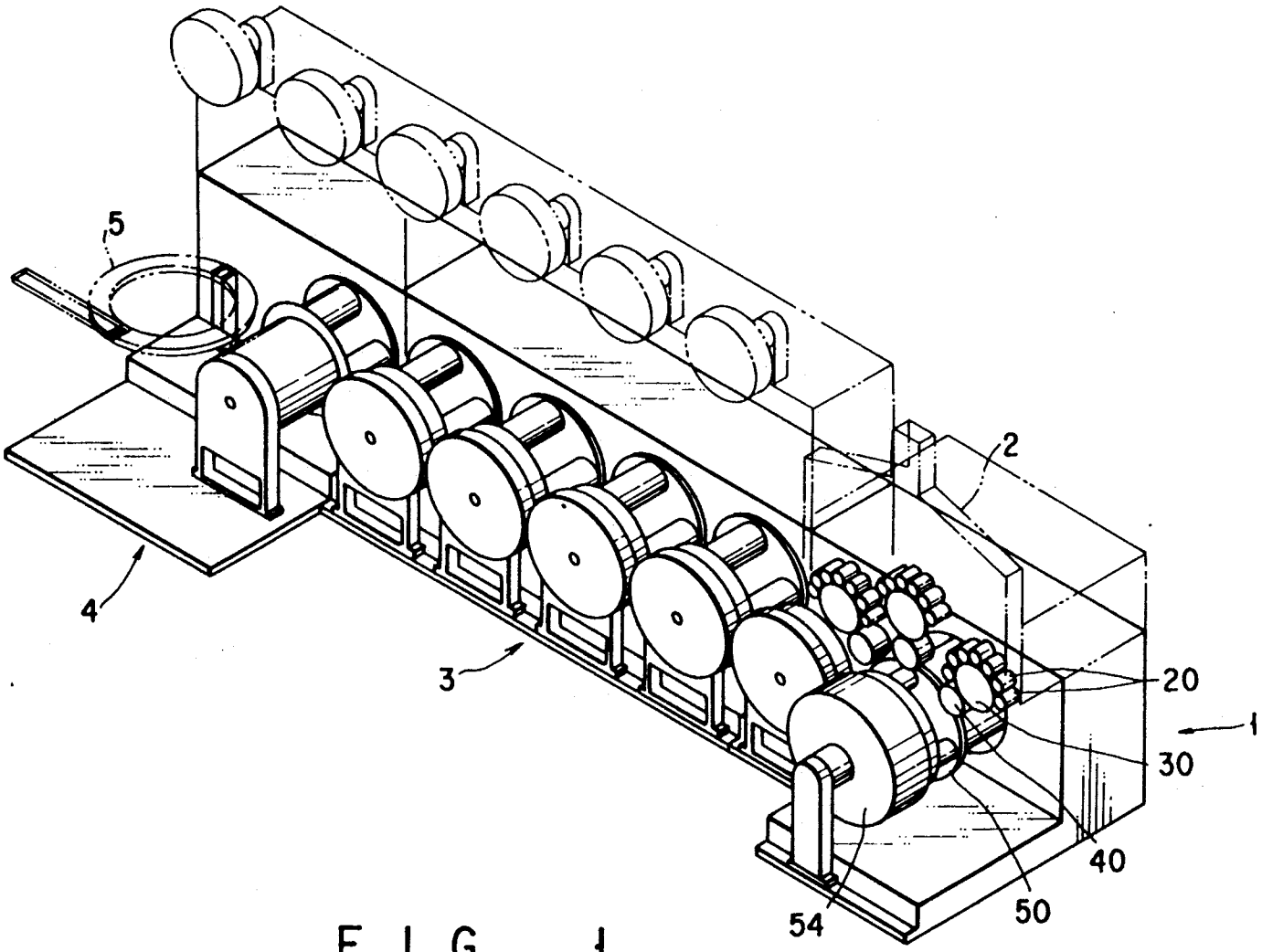
FIG. 1 is a perspective view of the overall cigarette wrapping apparatus according to this invention.

First, a cigarette wrapping apparatus for wrapping twenty cigarettes in a box will explained. The overall structure of the apparatus is shown in FIG. 1. A cigarette parallel-arranging device 1 has a hopper 2 into which a plurality of cigarettes are supplied from a cigarette manufacturing machine (not shown). Twenty cigarettes to be contained in a box are piled in three steps by means of the cigarette parallel-arranged device such that the lower, intermediate and upper steps include seven, six and seven cigarettes, respectively.

The piled cigarettes are supplied to a packing device 3 disposed adjacent to the cigarette parallel-arranging device 1, for automatically packing each set of twenty cigarettes to be contained in a box with aluminum foil or a wrapping sheet.

The packed product is applied with a seal by means of a sealing device 4 disposed adjacent to the packing device 3 and is delivered out of the packing device 3 by means of a taking-out conveyer 5.

The structure of the cigarette parallel-arranging device will be described with reference to FIGS. 2 to 5.

Figure 2:
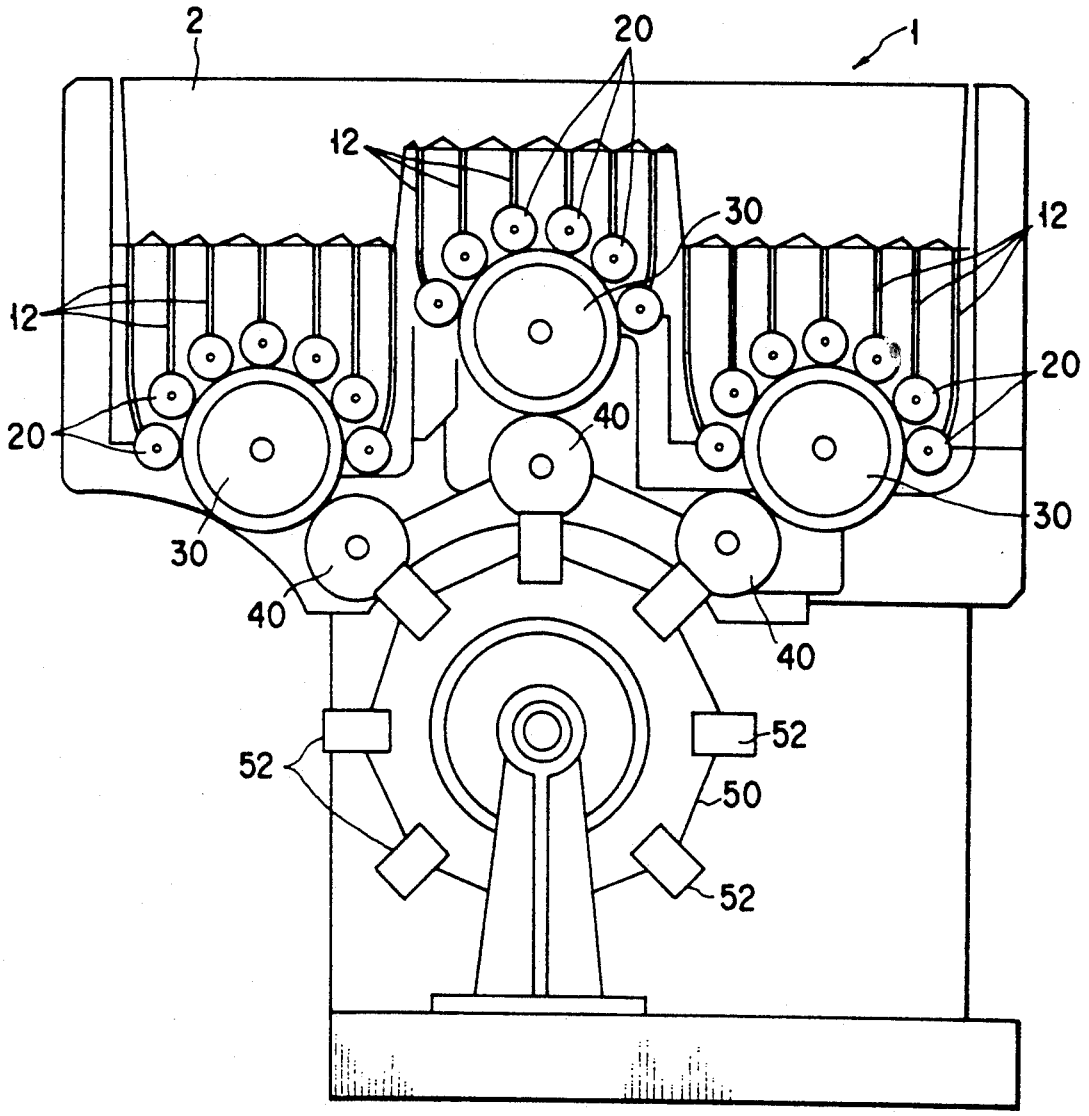
FIG. 2 is a front view of the cigarette parallel-arranging device for the cigarette wrapping apparatus as shown in FIG. 1.
Figure 4:
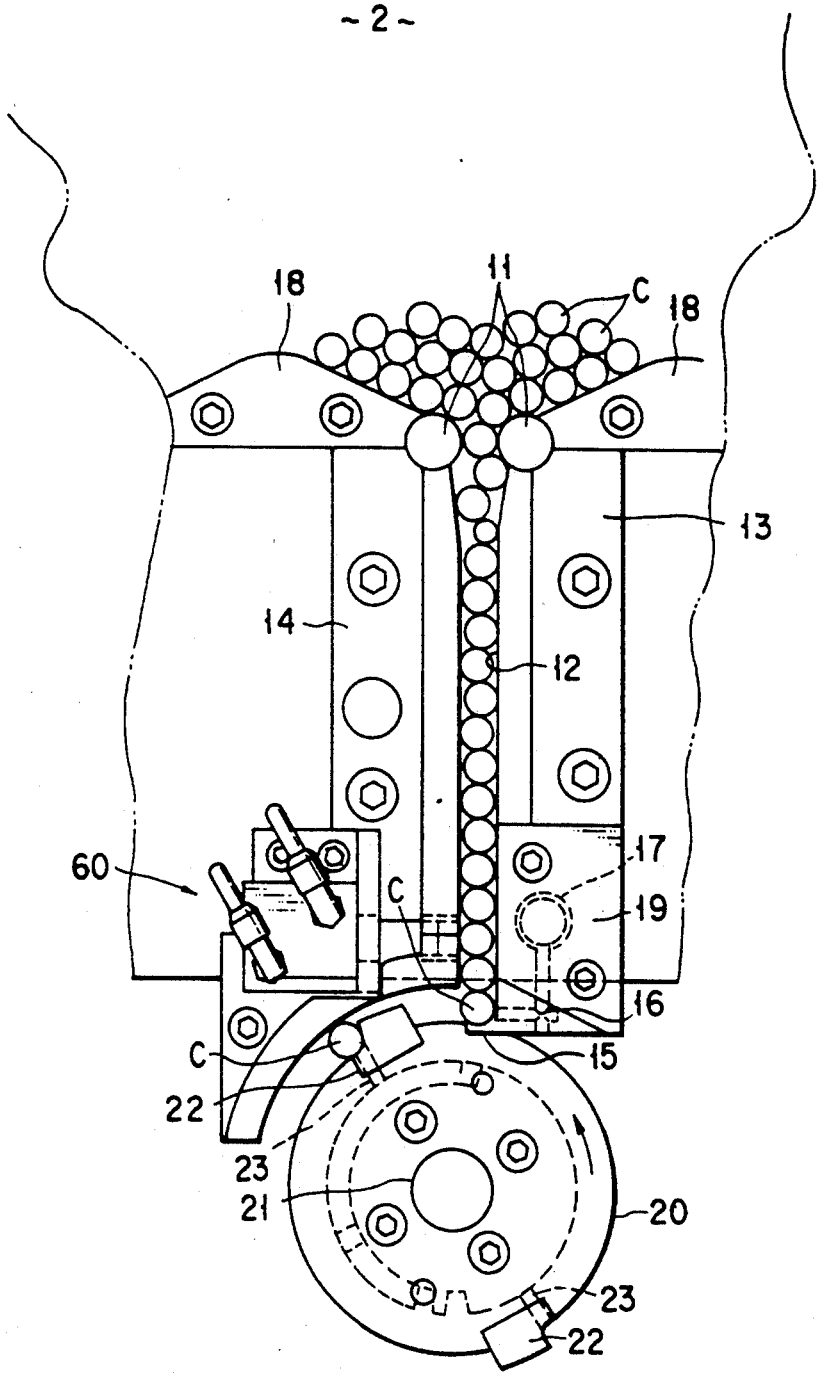
FIG. 4 is an enlarged front view of a part of this cigarette parallel-arranging device.

As shown in FIG. 2, twenty vertical cigarette supplying passageways 12 whose number corresponds to the number of cigarettes in a box are arranged parallel with each other at the bottom of the hopper 2. As shown in FIG. 4, the cigarette supplying passageways 12 are formed between the blocks 13 and 14 and their width is slightly larger than the diameter of each cigarette C.

An inverted V-shaped guide block 18 is fixed to the upper surface of each of the blocks 13 and 14. A pair of swingable agitator rollers 11 are provided on both sides of the upper end or inlet of each cigarette supplying passageway 12 so as to lead cigarettes C in the hopper 2 to the respective cigarette supplying passage 12. With this arrangement, cigarettes C in the hopper 2 are guided by the guide block 18 and supplied into the cigarette supplying passageways 12, one by one, by means of the agitator rollers 11. The cigarettes C are arranged in parallel with each other in the cigarette supplying passageways 12 and are moved downward by their own weight.

A cigarette holding block 19 is provided on the lower end or the outlet of each cigarette supplying passageway 12. A substantially vertical cigarette holding projection 15 is provided on the lower end portion of the cigarette holding block 19 so as to extend in the respective cigarette supplying passage 12. At the side wall of the cigarette holding projection 15 is opened a negative pressure nozzle 16 which communicates with a negative pressure path 17. The cigarettes C delivered into the cigarette supplying passageways 12 abut against the cigarette holding projections 15, and are sucked and held in position due to a negative pressure produced by the negative pressure nozzles 16.

As shown in FIGS. 2 and 4, a cigarette receiving drum 20 is provided at the lower end of each cigarette supplying passageway 12. Each cigarette receiving drum 20 is mounted on a rotary shaft 21 and rotated in the direction of an arrow in FIG. 4. A plurality of (two, for example) cigarette receiving members 22 are provided on the peripheral surface of each cigarette receiving drum 20. In the forward portion of a side face of each cigarette receiving member 22 is formed a semicircular groove for holding a cigarette C. A negative pressure nozzle 23 is opened at the groove.

The cigarette C held by the cigarette holding projection 15 provided on the lower end of each cigarette supplying passageway 12 is accordingly received by the groove of the respective cigarette receiving member 22 and is held by a negative pressure.

As shown in FIG. 2, three cigarette parallel-arranging drums 30 are disposed adjacent to groups of the cigarette receiving drums 20 for the lower, intermediate and upper steps of cigarettes (seven cigarette receiving drums for the lower step, six cigarette receiving drums for the intermediate step and seven cigarette receiving drums for the upper step). Each cigarette parallel-arranging drum 30 is mounted on a rotary shaft 31 and rotated in the direction of an arrow in FIG. 5. The peripheral speed of each cigarette parallel-arranging drum 30 is rendered equal to the peripheral speed of the corresponding cigarette receiving drum 20. In the peripheral surface of each cigarette parallel-arranging drum 30 are formed a plurality of groups of cigarette parallel-arranging grooves 32. The number of each group of cigarette parallel-arranging grooves 32 is seven or six according to the number of the corresponding group of the cigarettes C. When a group of cigarette parallel-arranging grooves 32 pass the region of the respective cigarette receiving drum 22, cigarettes C are received by the corresponding group of cigarette parallel-arranging grooves 32. In this way, each group of cigarette parallel-arranging grooves 32 receive the respective group of cigarettes C. A negative pressure nozzle (not shown) is opened at each cigarette parallel-arranging groove 32 and a cigarette C received by the groove 32 is held by a negative pressure.

Figure 5:
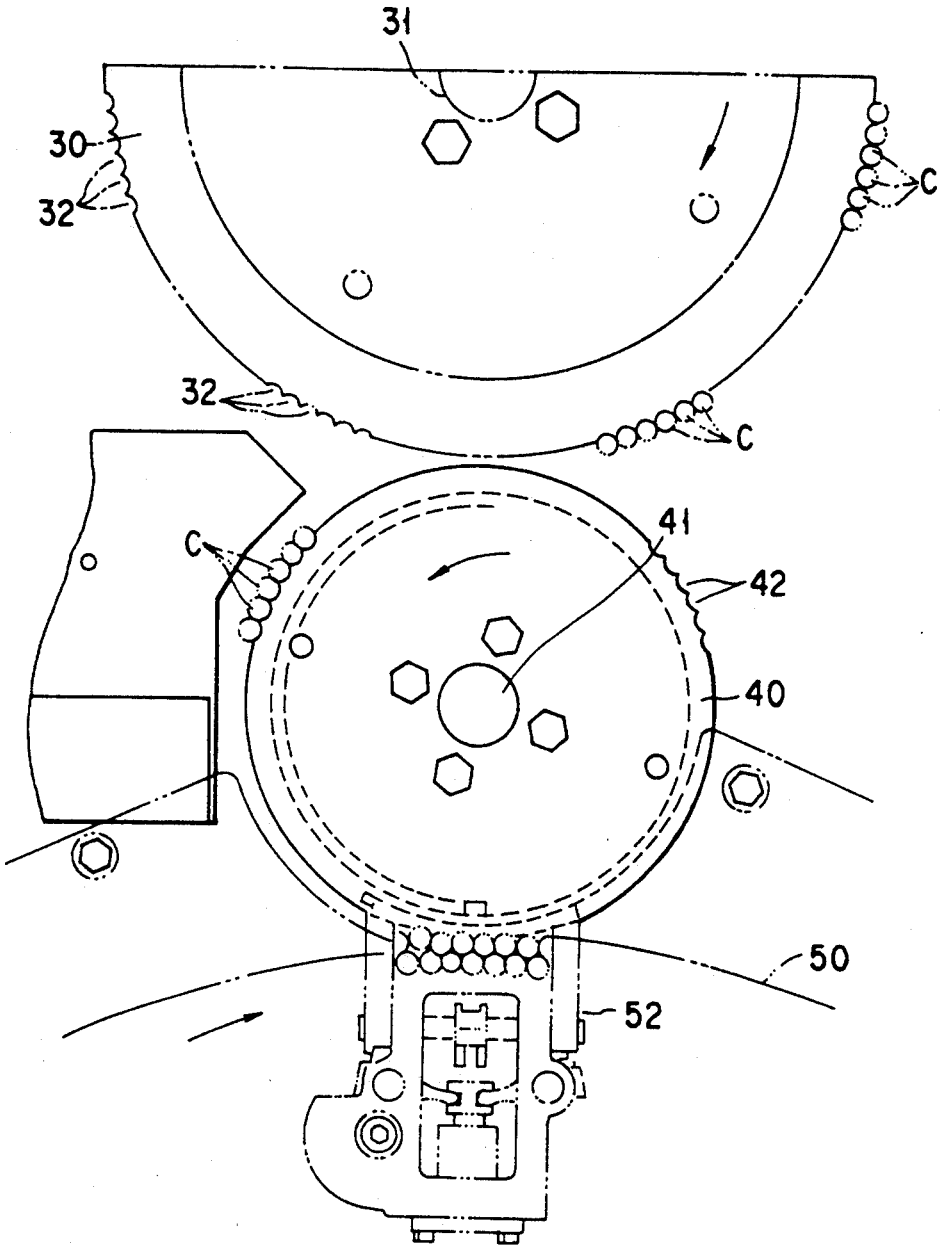
FIG. 5 is an enlarged front view of a part of a variable speed transferring device of this cigarette parallel-arranging device.

As shown in FIGS. 2 and 5, the transferring drum 40 of a variable speed transferring device is provided adjacent to each cigarette parallel-arranging drum 30 and is mounted on a rotary shaft 41 so as to be rotated in the direction of an arrow in FIG. 5. In the peripheral surface of each transferring drum 40 are formed a plurality of cigarette holding grooves 42. A negative nozzle is opened at each cigarette holding groove 42. The group of cigarettes C held in each group of cigarette parallel-arranging grooves 32 of a cigarette parallel-arranging drum 30 are transferred to a group of cigarette holding grooves 42 of the corresponding transferring drum 40.

As shown in FIGS. 2 and 5, a cigarette piling drum 50 is provided adjacent to the three transporting drums 40. The cigarette piling drum 50 is mounted on a rotary shaft 51 and is rotated in the direction of an arrow in FIG. 5. On a side of the cigarette piling drum 50 are provided a plurality of heads 52. When each head 52 passes the region of each transporting drum 40, each group of cigarettes C are transported to the head 52. After the head 52 has passed the regions of the three transporting drums 40, twenty cigarettes C are piled in three steps in a staggered manner.

Figure 3:
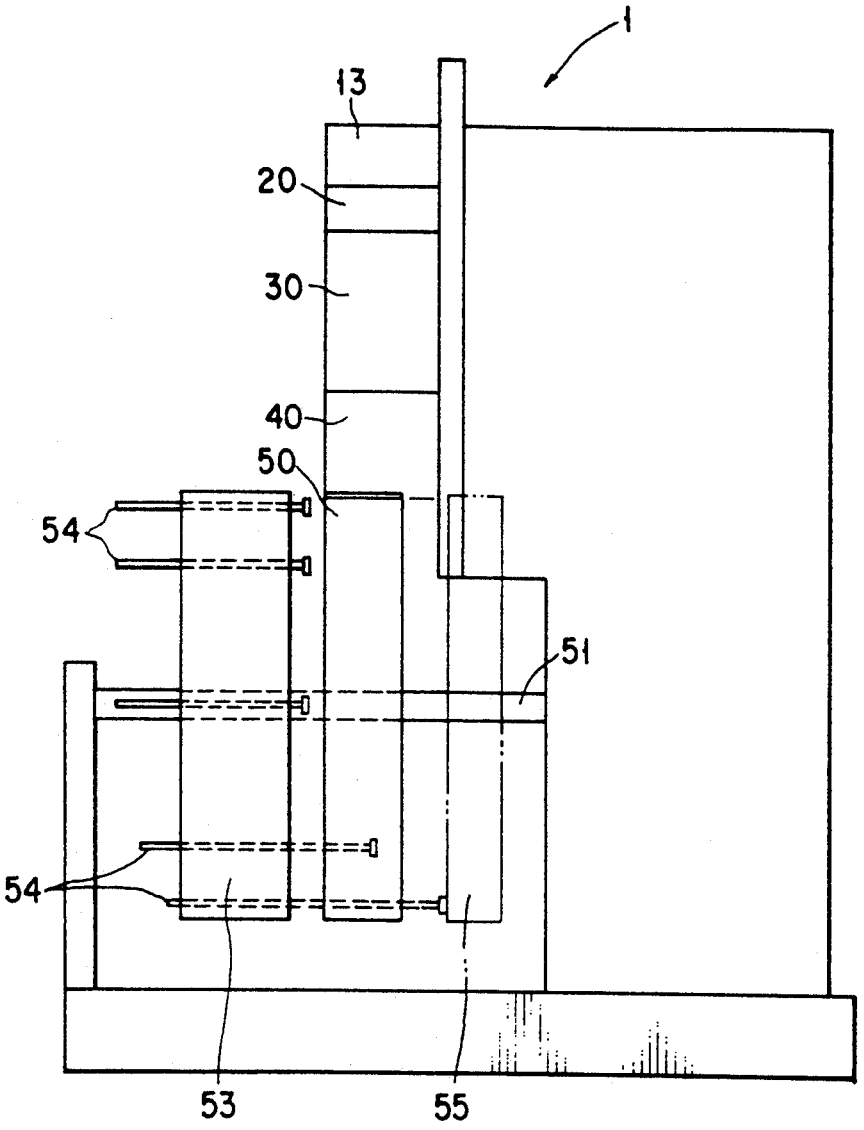
FIG. 3 is a side view of the cigarette parallel-arranging device as shown in FIG. 2.

As shown in FIG. 3, a pushing-out drum 53 rotated together with the cigarette piling drum 50 is mounted on the rotary shaft 51 and is provided with pushers 54 for pushing out twenty cigarettes C held by each head 52 so as to be caused to face a head 52. Twenty cigarettes C are packed in a box by means of the packing device 3 and a seal is applied to the resultant cigarette package by means of the sealing device 4.

Figure 6:
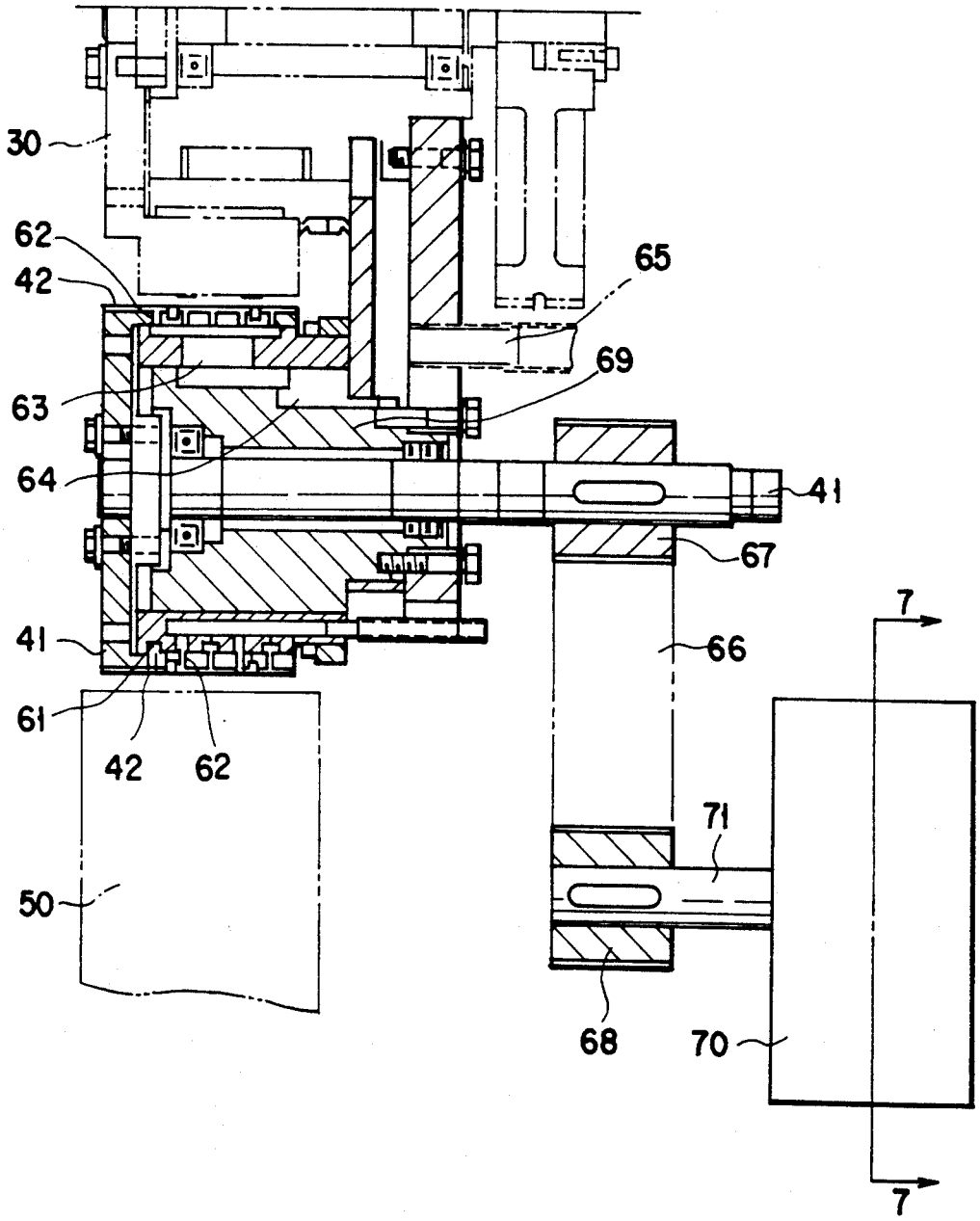
FIG. 6 is a longitudinal cross-sectional view of the variable speed transferring drum.

A variable speed transferring device will be described with reference to FIGS. 5 to 8. The variable speed drum 40 is cylindrical as shown in FIG. 6. A negative pressure nozzle 62 is opened at the bottom of each cigarette holding groove 42 on the side of the variable speed drum 40. A fixed cylindrical member 69 is fitted in the cylindrical variable speed transferring drum 40 with a slight gap left between the inner face of the drum 40 and the outer surface of the member 29. In a side of the member 69 is formed a control groove 61 extending circumferentially of the member 69. The control groove 61 communicates with a negative pressure pipe 65 through negative pressure paths 63 and 64. The control groove 61 is formed merely in such a predetermined circumferential portions of the member 69 that a negative pressure is produced in the negative pressure nozzle 62 only when the nozzle 62 aligns with the control groove 65 such that the cigarette C is sucked and held on the cigarette holding grooves 42. The control groove 61 extends substantially half a circumference of the member 69 extending between the cigarette parallel-arranging drum 30 and the cigarette piling drum 30 such that the cigarettes C delivered from the cigarette parallel-arranging drums 30 are sucked and held only during the time interval when the cigarettes C are transferred from the cigarette parallel-arranging drums 30 to the cigarette piling drum 50.

Figure 7:
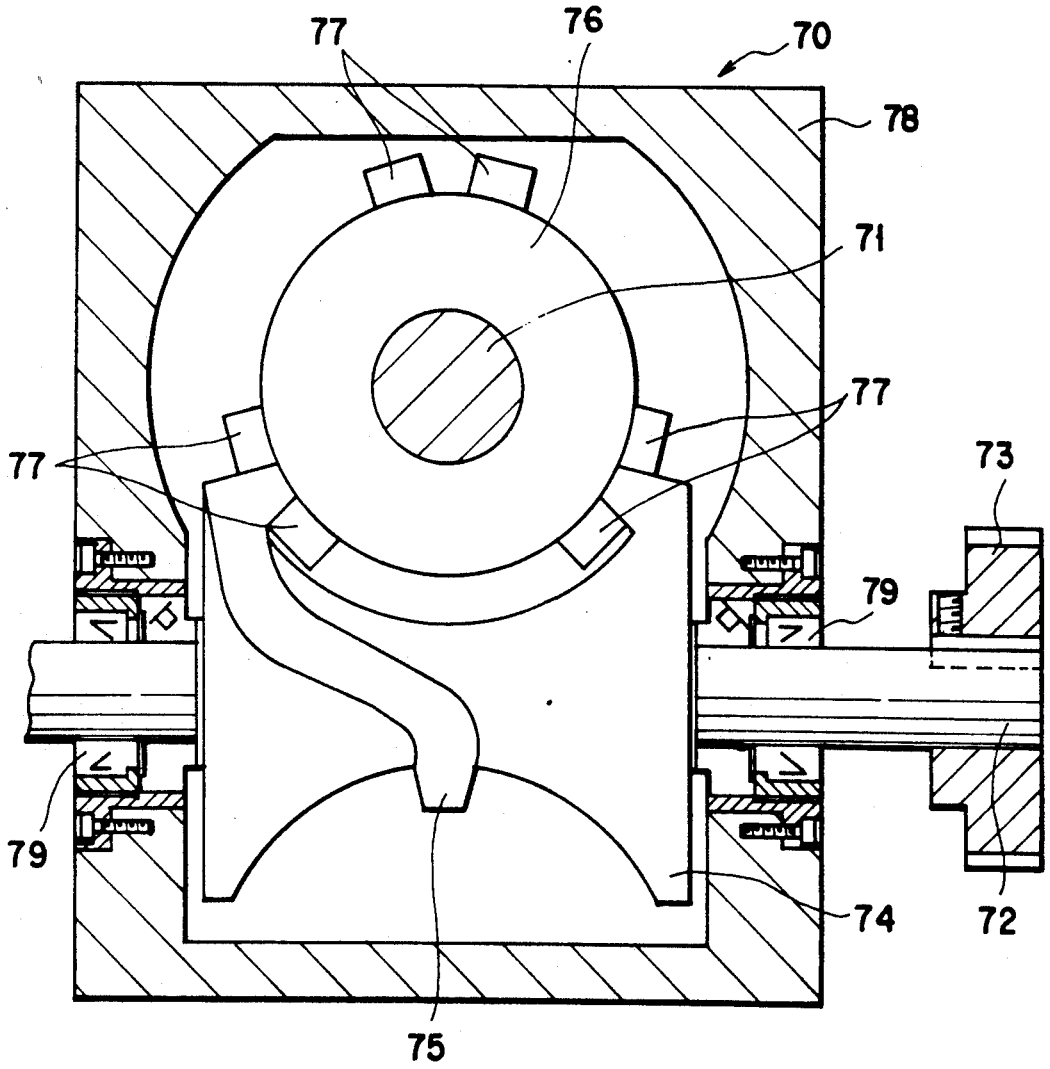
FIG. 7 is a cross-sectional view of a variable speed driving mechanism along line 7—7 in FIG. 6.

As shown in FIGS. 6 and 7, the variable speed transferring drum 40 is driven by a variable speed driving mechanism 70. The rotary shaft 41 is connected to the output shaft 71 of the variable speed driving mechanism 70 through toothed pulleys 67 and 68 and a gear belt 66.

The variable speed driving mechanism 70 has a structure as shown in FIG. 7 and is intended to change the rotational speed (i.e., the peripheral speed) of the variable speed transferring drum 40 periodically during one revolution thereof.

The variable speed driving mechanism 70 has a casing 78, the output shaft 71 and an input shaft 72 extending perpendicular to the output shaft 71. Bearings are designated at 79. The input shaft 72 is connected to a constant speed driving source such as a motor via a gear 73, etc. A cam wheel 74 is fixed to the input shaft 72 and a driven wheel 76 is fixed to the output shaft 71. The cam wheel 74 has a drum shape which accords with the circular face of the driven wheel 76. A continuous cam ridge 75 extends circumferentially on the outer peripheral surface of the cam wheel 74. A plurality pairs of driven rollers 77 are rotatably provided on the outer peripheral surface of the driven wheel 76. These pairs of driven rollers 77 are provided such that they correspond to the groups of the cigarette holding grooves 42. Since, therefore, three groups of cigarette holding grooves 42 are provided in this embodiment, the number of pairs of driven rollers 77 is also three. Each pair of cam rollers 77 can engage the cam rim 75 and sandwich the same. Every time each pair of driven rollers 77 engage the cam ridge 75, the driven wheel 76 is rotated by changing the rotational speed according to cam charts relating to the cam ridge 75. In this embodiment, the variable speed transferring drum 40 changes periodically at a frequency of three times per one revolution of the driven wheel 76.

Figure 8:
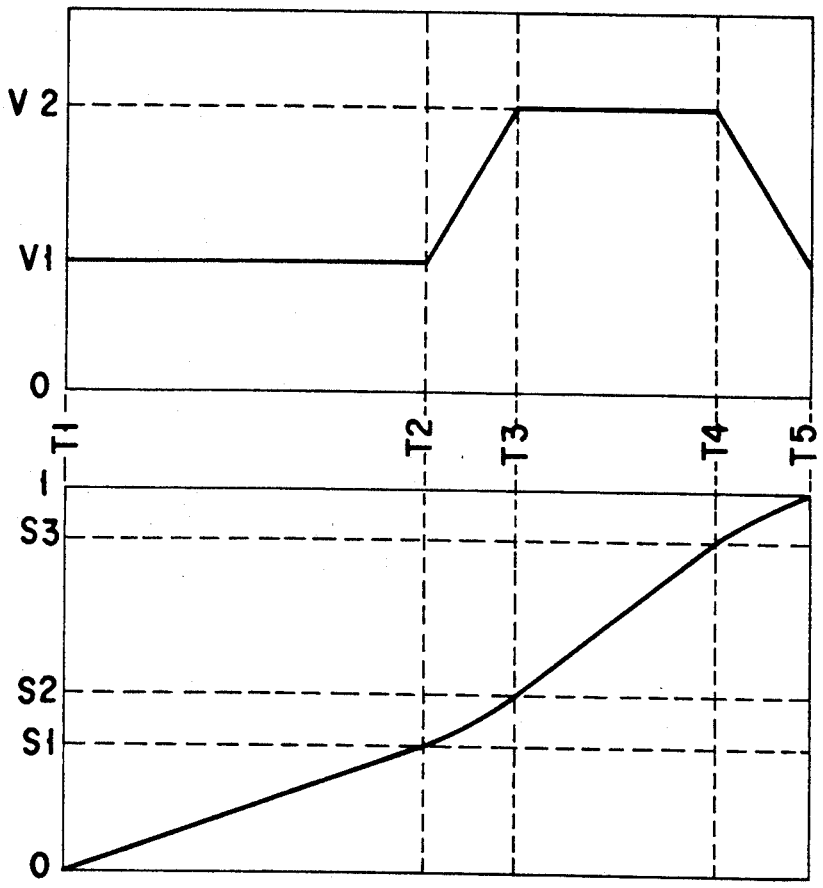
FIG. 8 shows cam charts of the variable driving mechanism.

FIG. 8 shows cam characteristics indicating this periodical change of the rotational speed which occurs from the time when a pair of driven rollers 77 engage the cam rim 75 to the time when the following pair of driven rollers 77 engage the cam ring 75 (i.e., the behavior of one third rotation of the variable speed transferring drum 40) is shown by the charts in FIG. 8.

In the charts of FIG. 8 are shown the operational characteristics of the variable speed transferring drum 40 between time T1 to time T5 at which a pair of driven rollers engage the cam ridge 75, i.e., during the time interval of one-third revolution of the variable speed transferring drum 40. The T-V curve shows the change of the rotational speed (the peripheral speed) of the variable speed transferring drum 40 during the time interval between T1 to T5. The drum 40 rotates at a lower speed of V1 between T1 and T2 and at a higher speed of V2 between T3 and T4. The T-S curve shows the rotational displacement of the variable speed transferring drum 40 in which the displacement is made at the constant speed of V1 between T1 and T2 and at another constant speed of V2 between T3 and T4. Since the rotational speed of the variable speed transferring drum 40 continuously changes from T2 to T3 and from T4 to T5 as seen from the T-V curve, the drum 40 makes a continuous rotational displacement during these time intervals as seen from the T-S curve. In this regard, the shock applied to cigarettes during the change of the rotational speed of the drum 40 is remarkably reduced.

As described above, the variably rotational characteristics are related to a plurality of groups of cigarette holding grooves 42. When a group of cigarette holding grooves 42 receive cigarettes C from the corresponding cigarette parallel-arranging drum 30, the variable speed transferring drum 40 rotates at a lower speed of V1, whereby the peripheral speed of the drum 40 is reduced. On the other hand, when the cigarette holding grooves 42 approach the head 52 of the cigarette piling drum 50 and the parallel-arranged cigarettes C are received by the drum 50, the variable speed transferring drum 40 rotates at a higher speed of V2, leading to a higher peripheral speed of the drum 40.

Therefore, the shock applied to cigarettes C when they are received by the cigarette receiving drums 20 from the cigarette supplying passageways 12 is reduced by making the peripheral speeds of the drums disposed upstream of the variable speed drums 40, i.e., the cigarette parallel-arranging drums 30 and the cigarette receiving drums 20 smaller than the drum disposed downstream of the variable speed drum 40, i.e., the cigarette piling drum 50.

Since, in this embodiment, the cigarette parallel-arranging drums 30 are disposed separated by 180 degrees from the cigarette piling drum 50 with respect to the speed variable transferring drums 40, an odd number of groups of cigarette holding grooves 42 are provided on each variable speed transferring drum 40 such that the groups of cigarette holding groove 42 do not face the cigarette parallel-arranging drums 30 and the cigarette piling drum 50 simultaneously. However, when the angular separation between the cigarette parallel-arranging drums 30 and the cigarette piling drum 50 with respect to the variable speed transferring drum 40 is changed, an even number of cigarette holding grooves can be provided on each variable speed transferring drum 40.

The variable speed driving mechanism is not limited to the one employing a cam mechanism.

According to this invention, the peripheral speed of the drums disposed upstream of the variable speed transferring drums is lowered whereby the shock which is applied to cigarettes when they are transferred from the cigarette supplying passageways to the cigarette receiving drums is reduced. The variable speed transferring device has such large technical advantages that cigarettes are prevented from being damaged and the operation of the device is speeded up.

Additional advantages and modifications will readily occur to those skilled in the art. Therefore, the invention in its broader aspects is not limited to the specific details, representative devices, shown and described herein. Accordingly, various modifications may be made without departing from the spirit or scope of the general inventive concept as defined by the appended claims and their equivalents.

What is claimed is:

1. A cigarette wrapping apparatus comprising cigarette parallel-arranging device for forming groups of parallel-arranged cigarettes and for piling said groups of cigarettes in a staggered manner and a wrapping device for wrapping said cigarettes which have been piled, wherein:

said cigarette parallel-arranging device comprises a plurality of cigarette parallel-arranging drums for forming groups of parallel-arranged cigarettes and holding said groups of cigarettes, and a cigarette piling drum for receiving said groups of cigarettes from said cigarette parallel-arranging drums and piling said groups of cigarettes in a staggered manner;

a plurality of variable speed transferring drums disposed between said cigarette parallel-arranging drums and said cigarette piling drum, for receiving said groups of cigarettes from said cigarette parallel-arranging drums and transferring said groups of cigarettes to said cigarette piling drum, each variable speed transferring drum being provided on a peripheral surface thereof with at least one group of holding grooves for holding one of said groups of cigarettes; and variable speed driving mechanism for driving said variable speed transferring drums at a speed which is changed periodically during each revolution of said variable speed transferring drums such that said variable speed transferring drums are driven at a lower speed when said group of holding depressions approach the corresponding variable speed transferring drum and at a higher speed when said group of holding depressions pass by said cigarette piling drum.

2. The apparatus according to claim 1, wherein said variable speed driving mechanism comprises a cam mechanism for changing said speed of said variable speed transferring drums periodically during each revolution thereof.

3. The apparatus according to claim 1, wherein each of said variable speed transferring drums is provided on said peripheral surface thereof with a plurality groups of holding grooves.

* * * * *